US006010995A

United States Patent [19]

Van Eenam

[11] Patent Number: 6,010,995

[45] Date of Patent: Jan. 4, 2000

[54] NO/LOW VOLATILE ORGANIC COMPOUND CLEANER/DEGREASER COMPOSITION

[75] Inventor: Donald N. Van Eenam, Des Peres, Mo.

[73] Assignee: Buckeye International, Inc., Maryland Heights, Mo.

[21] Appl. No.: 09/245,240

[22] Filed: Feb. 5, 1999

Related U.S. Application Data

[63] Continuation of application No. 08/921,004, Aug. 29, 1997, abandoned, which is a continuation of application No. 08/579,816, Dec. 28, 1995, abandoned.

[51] Int. Cl.[7] ..... C11D 3/20

[52] U.S. Cl. ..... 510/365; 510/174; 510/245; 510/401; 510/405; 510/411; 510/417; 510/421; 510/434; 510/505

[58] Field of Search ..... 510/174, 365, 510/405, 411, 401, 417, 421, 245, 434, 505

[56] References Cited

U.S. PATENT DOCUMENTS

| | | | |
|---|---|---|---|
| 3,740,352 | 6/1973 | Sommers | 508/209 |
| 4,169,817 | 10/1979 | Weber | 510/321 |
| 4,511,488 | 4/1985 | Matta | 510/421 |
| 5,080,831 | 1/1992 | Van Eenam | 510/365 |
| 5,158,710 | 10/1992 | Van Eenam | 510/264 |
| 5,419,848 | 5/1995 | Van Eenam | 510/365 |

FOREIGN PATENT DOCUMENTS

| | | |
|---|---|---|
| 91/09104 | 6/1991 | WIPO . |

*Primary Examiner*—Lorna M. Douyon
*Attorney, Agent, or Firm*—Senniger, Powers, Leavitt & Roedel

[57] ABSTRACT

A low volatile organic component stable, aqueous cleaning/degreasing composition in the form of a macroemulsion is formulated by combining (a) a nonionic surfactant having certain specified characteristics; (b) an oligomeric or mono/polyfunctional hydrophobe having certain specified characteristics; and (c) water, the nonionic surfactant and hydrophobe being present in a weight ratio of between approximately 10:1 and 1:3 and the composition having a minimum composite score of 60% removal in the soilant marking removal test. Such compositions not only contain no or low amounts of volatile organic compounds but are environmentally safe and non-toxic and exhibit excellent cleaner/degreaser activity exceeding that exhibited by either the nonionic surfactant or hydrophobe component alone at equivalent or equal concentration.

18 Claims, No Drawings

NO/LOW VOLATILE ORGANIC COMPOUND CLEANER/DEGREASER COMPOSITION

CROSS REFERENCE TO RELATED APPLICATIONS

This is a continuation of application Ser. No. 08/921,004, filed Aug. 29, 1997, now abandoned, which is a continuation of application Ser. No. 08/579,816, filed Dec. 28, 1995, now abandoned.

BACKGROUND OF THE INVENTION

This invention relates to cleaner/degreaser compositions and, more particularly, to such compositions which are formulated to contain no or low amounts of volatile organic compounds and yet exhibit excellent cleaner/degreaser efficacy.

It is common knowledge that volatile organic compound emissions pose an environmental hazard. It would be environmentally desirable and beneficial to develop cleaner/degreaser compositions which contain no volatile organic compounds or small amounts thereof and in which the organic components are fully and readily biodegradable, non-volatile (e.e. have little or no vapor pressure at ambient temperatures and pressures), environmentally safe and non-toxic, effective and efficient in promoting cleaning/degreasing in the most difficult industrial applications, easily and readily formulated into stable, aqueous-based compositions, compatible with other commonly used builders, chelants and other components, and shelf and freeze/thaw stable.

While aqueous cleaner/degreaser compositions have been developed which exhibit superior cleaning and degreasing capability (e.g. see my U.S. Pat. Nos. 5,080,822, 5,080,831, 5,158,710 and 5,419,848), such compositions preferably contain volatile organic solvents such as 2-phenoxyethanol, 1-phenoxy-2-propanol, benzyl alcohol, β-phenylethanol, acetophenone or the like.

There is a continuing need, therefore, for cleaner/degreaser compositions with efficacious cleaning and degreasing capability but which contain no or only low and acceptable amounts of volatile organic compounds.

SUMMARY OF THE INVENTION

Among the several objects of the invention may be noted the provision of stable, aqueous cleaner/degreaser compositions which contain no or low amounts of volatile organic compounds; the provision of such compositions in which the organic compound components are fully and readily biodegradable; the provision of compositions of this type which may be formulated as aqueous emulsions, or microemulsions; the provision of such compositions which are environmentally safe and non-toxic; the provision of such compositions which are shelf and freeze/thaw stable; and the provision of such compositions which may be readily formulated from available components. Other objects and features will be in part apparent and in part pointed out hereinafter.

Briefly, the present invention is directed to a low volatile organic component stable, aqueous cleaning/degreasing composition in the form of a macroemulsion comprising (a) a nonionic surfactant characterized by:

(i) having an aqueous solubility in the range of approximately 0.1 to 5 wt. %;

(ii) having a cloud point of ≦20° C. at a concentration of 1.0 wt. % in water;

(iii) having a hydrophilic/lipophilic balance (HLB) between approximately 3 and 12;

(iv) having a minimum composite score of 60% removal in the soilant markings removal test method;

(v) being self-emulsifiable in water; and (vi) being selected from the group consisting of ethoxylated alkanols, alkylphenols and carboxylic acids; polyol esters, polyetherol esters, and 1:1 diethanolamides;

(b) an oligomeric or mono/polyfunctional hydrophobe characterized by:

(i) having an aqueous solubility less than that of said nonionic surfactant;

(ii) having a viscosity not exceeding approximately 5000 centipoise at ambient temperature;

(iii) being miscible with and capable of forming a liquid macroemulsion with said nonionic surfactant;

(iv) being capable of suppressing the aqueous solubility of said nonionic surfactant;

(v) having a low volatility not exceeding approximately 0.02 mm at 25° C.;

(vi) not being a hydrocarbon or halocarbon; and (vii) being a solvent for hydrophobic soilants; and (c) water said nonionic surfactant and said hydrophobe being present in a weight ratio of between approximately 10:1 and 1:3 at ambient temperature and said composition having a minimum composite score of 60% removal in the soilant markings removal test method.

The compositions of the invention unexpectedly exhibit excellent cleaner/degreaser activity far exceeding that action exhibited by either the nonionic surfactant or hydrophobe component alone at equivalent or equal concentration.

DESCRIPTION OF THE PREFERRED EMBODIMENTS

In accordance with the present invention, it has now been found that low volatile organic components provide stable, aqueous cleaning/degreasing compositions in the form of macroemulsions and having excellent cleaning and degreasing capabilities may be formulated by combining a nonionic surfactant having certain characteristics with an oligomeric or mono/polyfunctional hydrophobe having certain characteristics, it being essential that the nonionic surfactant and the hydrophobe be present in a weight ratio of between approximately 10:1 and 1:3 at ambient temperature. More preferably, the nonionic surfactant and hydrophobe components of the compositions of the invention are present in a weight ratio between approximately 5:1 and 1:1.5.

It has been observed that many sparingly water soluble hydrophobic materials such as poly (propyleneoxy)-based mono, di, and polyol materials exhibit at best modest degreasing efficacy and to a much lower degree than volatile solvents such as 2-phenoxyethanol, 1-phenoxy-2-propanol, β-phenylethanol, benzyl alcohol, acetophenone and others. Similarly, under dilution in aqueous solution or emulsion form, most nonionic surfactants, especially aromatic ring containing types such as alkylphenol ethoxylates (e.g. those marketed under the trade designations Triton X-45, Triton X-114, T-Det N-8 and T-Det N-9.5) exhibit little degreasing capability. For example, the latter specific surfactants per se fail to remove black indelible magic marker felt pen, blue and black indelible ball point pen and many similar oil/grease-borne markings from alkyd enameled metal surfaces despite their aromaticity and relatively low HLB values.

Further, while relatively low HLB possessing aliphatic based alkanol/ethoxylate condensates and aliphatic based diethanolamide surfactants function to dissolve a number of oil/grease-borne markings, this only occurs when such surfactants are used in undiluted form and the presence of diluting water greatly diminishes the solvency action of such surfactants.

Unexpectedly, in accordance with the present invention, it has been found that when a nonionic surfactant and an oligomeric or mono/polyfunctional hydrophobe having certain defined characteristics as set forth below are combined, a synergism is produced between these components resulting in a low volatile organic component stable, aqueous cleaning/degreasing composition which exhibits superior cleaning/degreasing efficacy. For use in the present invention, the nonionic surfactant component must have the following characteristics:

(a) it must have limited water solubility in the range of 0.1 to 5 wt. %;

(b) it must have a cloud point of ≦20° C. at a concentration of 1.0 wt. % in water;

(c) it must have a hydrophilic/lipophilic balance (HLB) between approximately 3 and 12;

(d) it must have a minimum composite score of 60% removal in the soilant markings removal test method described hereinafter;

(e) it must be self-emulsifiable in water; and (f) it is selected from the group consisting of ethoxylated alkanols, alkylphenols and carboxylic acids; polyol esters; polyetherol esters; and 1:1 diethanolamides Among the specific nonionic surfactants having these characteristics and which may be employed in the practice of the invention may be mentioned 2-ethylhexanol/2 E.O. condensate (trade designation "Ethal EH-2"), 2-ethylhexanol/5 E.O. condensate (trade designation "Ethal EH-5"), isodecanol/4 E.O. (trade designation "Ionol DA-4"), isodecanol/6 E.O. (trade designation "Ionol DA-6"), hexanol, octanol, decanol/3 E.O. condensate (trade designation "Alfonic 610-50R"), octanol, decanol/3 E.O. condensate (trade designation "Alfonic 810-40") octanol, decanol/5 E.O. condensate (trade designation "Alfonic 810-60"), $C_9$–$C_{11}$ alkanol/2.5 E.O. condensate (trade designation "Neodol 91-2.5"), lauryl alcohol/4E.O. condensate, (trade designation "Macol LA-4"), tridecanol/3 E.O. condensate (trade designation "Macol TD-3"), tridecanol/4 E.O. condensate (trade designation "Macol TD-4"), decanol/dodecanol/3 E.O. condensate (trade designation "Ethonic 1012-3"), $C_{12}$–$C_{14}$ alkanol/2 E.O. condensate (trade designation "Ethonic 1214-2"), $C_{12}$–$C_{13}$ linear alcohol/3 E.O. condensate (trade designation "Neodol 23-3"), $C_{12}$–$C_{15}$ linear alcohol/3 E.O. condensate (trade designation "Neodol 25-3"), $C_{11}$–$C_{15}$ secondary alcohol/3 E.O. condensate (trade designation "Tergitol 15-S-3"), $C_{11}$–$C_{15}$ secondary alcohol/5 E.O. condensate (trade designation "Tergitol 15-S-5"), octylphenol ethoxylate (trade designation "Triton X-45"), polyethylene glycol (400) monooleate (trade designation "Mopeg 400 MO"), polyethylene glycol (200) monolaurate (trade designation "Mopeg 200 ML"), soyamide diethanolamide (1:1) trade designation "Mackamide S"), linoleamide diethanolamide (1:1) trade designation "Monamide 15-70W"), lauramide diethanolamide (1:1) (trade designation "Mackamide LLM"), oleamide diethanolamide (1:1) (trade designation "Clindrol 100-0"), and isostearamide diethanolamide (1:1) (trade designation "Monamid 150 IS"). The 1:1 diethanolamides are a class of nonionic surfactants derived from a 1:1 molar reaction between diethanolamine and varying length fatty acids such as stearic or oleic acid and only the 1:1 diethanolamides are useful in the present invention. It will be understood that other nonionic surfactants falling within the above-defined group and having the stated characteristics may also be employed in the practice of the invention.

Among the preferred nonionic surfactants for use in the practice of the invention may be mentioned ethoxylated alkanols and 1:1 diethanolamides and, more specifically, decyl alcohol/4 E.O. condensate, decanol/dodecanol/3 E.O. condensate, $C_{12}$–$C_{15}$ linear alcohol/3 E.O. condensate and the alkylphenol ethoxylate sold under the trade designation "Triton X-45". Further, as specified above, the nonionic surfactant component must have a hydrophilic/lipophilic balance (HLB) between approximately 3 and 12, and preferably, between approximately 8 and 11.

The other principal component of the compositions of the invention, an oligomeric or mono/polyfunctional hydrophobe, must have the following characteristics:

(a) it must have an aqueous solubility less than that of the nonionic surfactant component;

(b) it must have a viscosity not exceeding approximately 5000 centipoise at ambient temperature;

(c) it must be miscible with and capable of forming a liquid macroemulsion with the nonionic surfactant component;

(d) it must have a low volatility not exceeding approximately 0.02 mm at 25° C.;

(e) it must not be a hydrocarbon or halocarbon; and (f) it must be a solvent for hydrophobic soilants.

Among the specific hydrophobes having these characteristics and which may be employed in the practice of the invention may be mentioned polypropylene glycol (trade designations "P-1200", "P-2000" and "P-4000"), polypropylene glycol butyl ether (trade designation "Polyglycol L-1150"), butoxy polypropylene glycol (trade designation "Dowanol L-910"), poly (1,2-butylene glycol), poly (2,3-butylene glycol), poly (norbornane oxide glycol), poly (styrene oxide glycol), poly (phenylglycidyl ether glycol), poly (isobutylglycidyl ether glycol), poly (methylglycidyl ether glycol), phenoxypolypropylene glycol, polyoxypropylene n-butyl ether, polytetramethylene ether glycol, poly (tetrahydrofuran), poly (methylvinyl ether), poly (ethylvinyl ether), poly (isobutylvinyl ether), poly (diallyl ether), polyoxypropylene (30) trimethylolpropanetriol, poly [propylene oxide (10)/phenylglycidyl ether (10) glycol], polyoxypropylene (25) di-n-butyl ether, 1,3-diphenoxy-2-propoxy (poly) propylene glycol, poly (cyclohexene oxide glycol), poly (1,2-epoxydodecanol glycol), polyhexamethylene ether glycol, polyphenoxypolypropylene glycol, dibutyl phthalate, dipropylene glycol dibenzoate, 2,2,4-trimethyl-1,3-pentanediol monobutyrate, diphenyl ether, tridecanol and di 2-ethylhexyl adipate. It will be understood that many other hydrophobes having the stated characteristics set out above may also be used in the practice of the invention. In general, the oligomeric or mono/polyfunctional hydrophobe generally consists of one or more oxygen only containing functional groups, i.e. hydroxyl, ether, ester, carboxyl or keto, which may be similar or dissimilar.

As stated, the hydrophobe component must have an aqueous solubility less than that of the nonionic surfactant component, i.e. less than approximately 0.1 to 5 wt. %. Preferably and for optimum results, the hydrophobe component should have an aqueous solubility between approximately 0.01 and 0.08 wt. %. Moreover, it must be capable of suppressing the aqueous solubility of the nonionic surfactant component of the compositions of the invention and be miscible with and capable of forming a liquid macroemulsion with the nonionic surfactant. Importantly and essential to the practice of the invention, the hydrophobe component must have a low volatility not exceeding 0.02 mm at 25° C.

A critical feature of the invention is that the nonionic surfactant and hydrophobe components must be present in the compositions described in a weight ratio of between approximately 10:1 and 1:3 at ambient temperature and, more preferably, between approximately 5:1 and 1:1.5. Weight ratios of nonionic surfactant to hydrophobe outside these ranges will not produce satisfactory results. Further, the compositions of the invention should have a minimum composite score of 60% removal in the soilant markings removal test method described hereinafter and exemplified in the working examples.

Optionally, but desirably, the compositions of the invention may also contain a thickener which functions not only as a viscosifying thickener but also as an emulsion stabilizing agent stabilizing the emulsions of the invention against separation at elevated temperatures. Illustrative thickeners which may be used in the practice of the invention include acrylic acid/alkyl methacrylate copolymers (Acrysol ICS-1 or Acusol 820), carboxy acrylic polymers (Carbopol 940), guar gums, xanthan gums, polyacrylic acid crosslinked with polyalkenyl polyvinyl alcohol, ammonium alginate and sodium alginate. Other thickeners known to the art may also be used. When incorporated into the composition of the invention, preferably from approximately 0.2 to 1 wt. % of the thickener is used. The preferred thickeners include acrylic acid/alkyl methacrylate copolymers and carboxy acrylic polymers. Where the thickener component is one which contains free acidic groups (e.g. Accusol 820 or Carbopol 940), a neutralizing base such as mono-, di- or triethanolamine or other neutralizing base is incorporated to ionize or neutralize the free acid groups and produce the full thickening effect of the thickener component.

In my copending, coassigned application Ser. No. 289,754, now U.S. Pat. No. 5,516,459 there are disclosed stable, cleaning/degreasing compositions for heavy duty exterior and interior aircraft cleaning and/or degreasing, such compositions comprising a tertiary amine N-oxide surfactant such as cocodimethylamine N-oxide, a viscosifying polymer, an alkali metal silicate, an alkali metal nitrite and water. The advantages disclosed for such compositions in application Ser. No. 289,754 incorporated herein by reference may be realized for the compositions of the present invention by incorporating the same components therein to produce compositions which are especially useful for cleaning/degreasing of the interior of aircraft and for degreasing aircraft reverse thrusters coated with hydraulic fluid. Alternatively, the alkali metal silicate and alkali metal nitrite components may be added to the composition of this invention without the tertiary amine N-oxide surfactant. The alkali metal silicate component functions as a builder/corrosion inhibitor, is preferably present in the amount of between approximately 1 and 10 weight percent and is constituted by a sodium or potassium metasilicate, orthosilicate or other water-soluble silicate. The alkali metal nitrite component functions as a metal and metal alloy corrosion inhibitor, is preferably present in the amount of between 0.1 and 1 weight percent and is preferably constituted by sodium or potassium nitrite.

In addition to the above-noted components of the compositions of the invention, various optional adjuvants can be incorporated. These include fragrances, dyes, opacifiers, chelants (such as Hampene 100S or Versene 100), pH adjustants and anti-rust additives.

The compositions of the invention exhibit excellent cleaner/degreaser efficacy, are essentially odorless and contain no or only low and acceptable amounts of volatile organic compounds. With regard to cleaning/degreasing efficacy, the compositions exhibit a minimum composite score of 60% in the soilant or markings removal test shown in the working examples set forth hereinafter. This soilant or markings removal test involves removing five different markings from alkyd enameled metal surfaces upon 10 seconds light rubbing with a Kimwipe® tissue wetted with a composition of the invention.

The following examples illustrate the practice of the invention.

EXAMPLE 1

In the following examples of illustrative cleaner/degreaser compositions of the present invention, the compositions were subjected as indicated to the definitive, semiquantitative degreasing test method described below in order to measure their cleaning/degreasing efficacy.

A magnetic stirrer (Fisher Scientific Co., Catalog No. 14-1511-1A) provided with a vaned disc magnetic stir bar (⅞" (diameter)×⅝" (height), 22 mm×15 mm, Fisher Scientific Co., Catalog No. 14-511-98C) was used. In each instance, pre-cleaned, borosilicate glass microslides (3"×1", 1.0 mm thickness) were thinly smeared/rub-on coated with Vaseline brand white petroleum jelly on one side only to a distance of 1.0" form the bottom edge to provide a 1.0"×1.0" coated area. The test cleaner/degreaser solutions were employed at full strength unless otherwise indicated and in an amount sufficient to fill a 50 ml Pyrex beaker containing the vaned disc magnetic stirrer bar to a level of 40 ml. Each test solution and surrounding air were maintained at 21±0.50° C. and the test solution stirring rate was determined by a setting of "3" on the stirrer dial of the magnetic stirrer. The stirring disc was positioned off-center to accommodate each microslide, touching neither the beaker walls nor the microslide and rotating freely when in use. The microslide, in each test, rested upright on the beaker bottom, was allowed to lean against the lip of the beaker at an approximately 75° angle and was positioned with the Vaseline coated face or area facing upward away from the vaned disc magnetic stirrer bar.

For each test, the beaker containing the stirrer bar was filled to 40 ml. with the test cleaning/degreasing solution at the indicated concentration, placed atop the magnetic stirrer plate, and positioned off-center to accommodate the glass microslide, and yet allow the vaned disc stirrer bar to rotate or spin freely. The stirrer was turned on, the dial adjusted manually to the "3"stirring rate setting and the Vaseline® thin film coated glass microslide was introduced into the test solution bath in such a manner that the coated side faced upward and was positioned away from the stirrer bar. The time "0" was noted immediately on a watch or clock with a sweep second hand.

At appropriate time intervals, the glass microslide was briefly removed from the cleaner/degreaser solution bath and immediately "read" for "% Vaseline removed from the 1.0"×1.0" treated area", an objective determination, after which the microslide was immediately returned to the stirred aqueous cleaner/degreaser bath. The duration of the degreasing test is determined by the time needed for complete, 100% removal of the Vaseline® film from the glass microslide surface.

The accuracy of the above-described test method is of the order of ±5% as determined by replicate run averaging.

EXAMPLE 2

An aqueous cleaning/degreasing concentrate formulation was prepared having the following composition:

| Component | Wt. % |
|---|---|
| Decanol/dodecanol/3 E.O. condensate ("Ethonic 1012-3") | 30.0 |
| Polypropylene glycol ("P-2000") | 10.0 |
| Deionized $H_20$ | 160.0 |
| | 200.0 |

The composition was a white colored emulsion having a pH of 7.13, a total active content of 20.0 wt. % and a Brookfield viscosity (LV-#2 spindle, 30 rpm) of 970 centipoise. The composition was fully homogeneous and exhibited excellent shelf stability.

At a dilution of 1:4 with water, the formulation readily removed the following markings from an alkyd enameled metal panel. The markings were wet in the formulation for 15 seconds and then scrubbed for 15 seconds used a folded Kimwipe tissue:

Black Magic Marker indelible felt tip

Black permanent ballpoint pen

Blue permanent ballpoint pen

#1 Hardness (graphite) pencil

Red wax china marker

At a dilution of 1:2–1:5 with water, the formulation readily removed automotive grease and Takilube outside gear lubricant from alkyd enameled metal surfaces.

EXAMPLE 3

An aqueous cleaning/degreasing concentrate formulation was prepared having the following composition:

| Component | Wt. % |
|---|---|
| Decanol/dodecanol/3 E.O. Condensate ("Ethonic 1012-3") | 70.0 |
| Polypropylene glycol ("Dow PPG-2000") | 20.0 |
| Liquid lauramide diethanolamide, 1:1 ("Mackamide LLM, McIntyre) | 10.0 |
| | 100.0 |

This self-emulsifiable concentrate upon dilution or emulsification in water produced a potent cleaning/degreasing composition.

At a dilution of 1:20 with water, the composition effected 100% removal of the following markings from an alkyd enameled metal panel:

Black Magic Marker indelible felt tip

Black permanent ballpoint pen

Blue permanent ballpoint pen

#1 Hardness (graphite) pencil

Red wax china marker

Takilube outside gear lubricant (smearing)

Automotive grease (smearing)

The concentrate, at the various dilutions with water indicated below, was subjected to the degreasing test method of Example 1 with the following results:

At a dilution of 1:10:

1st attack on greased slide at 10 sec.
30% removal of grease at 30 sec.
70% removal of grease at 1.0 min.
100% removal of grease at 1.5 min.

At a dilution of 1:20:

1st attack on greased slide at 12 sec.
20% removal of grease at 30 sec.
55% removal of grease at 1.0 min.
80–85% removal of grease at 2.0 min.
100% removal of grease at 2.75 min.

At a dilution of 1:30:

1st attack on greased slide at 15 sec.
10% removal of grease at 30 sec.
15% removal of grease at 1.0 min.
45% removal of grease at 3.0 min.
70% removal of grease at 6.0 min.
90–95% removal of grease at 9.0 min.
100% removal of grease at 10.0 min.

EXAMPLE 4

An aqueous cleaning/degreasing concentrate formulation was prepared having the following composition:

| Component | Wt. % |
|---|---|
| Decanol/dodecanol/3 E.O. condensate ("Ethonic 1012-3") | 15.0 |
| Butoxy polypropylene glycol ("Dow L-910") | 5.0 |
| Deionized water | 80.0 |
| | 100.0 |

The mixed components were stirred for 15 minutes at room temperature at an emulsifying stirring rate until the composition was uniform. The resulting composition was an intensely white, milky or creamy emulsion having a pH of 6.84 and a Brookfield viscosity (LV-#2 spindle, 60 rpm) of 403 centipoise. The emulsion exhibited storage stability.

At a dilution of 1:4 with water, the composition effected 100% removal of each of the markings listed in Example 2.

The composition, at a 1:4 dilution with water, was subjected to the degreasing test method of Example 1 with the following results:

1st attack on greased slide at 6 sec.

25–30% removal of grease at 30 sec.

65% removal of grease at 1.0 min.

75–80% removal of grease at 1.5 min.

100% removal of grease at 2.0 min.

EXAMPLE 5

An aqueous cleaning/degreasing concentrate formulation was prepared having the following composition:

| Component | Wt. % |
|---|---|
| "Ethonic 1012-3" | 15.0 |
| Butoxy polypropylene glycol ("Dow L-1150") | 5.0 |
| Deionized water | 80.0 |
| | 100.0 |

The composition was prepared as described in Example 4 and produced an intensely white, creamy emulsion having a pH of 6.92 and a Brookfield viscosity (LV-#2 spindle, 30 rpm) of 925 centipoise. The emulsion exhibited excellent stability.

At a dilution of 1:4 with water, the composition effected 100% removal of the markings listed in Example 2 except for the black ballpoint pen marking as to which a 90% removal was effected.

The composition, at a 1:4 dilution with water, was subjected to the degreasing test method of Example 1 with the following results:

1st attack on greased slide at 8 sec.

20–25% removal of grease at 30 sec.

45% removal of grease at 1.0 min.

70% removal of grease at 1.5 min.

80–85% removal of grease at 2.0 min.

100% removal of grease at 2.67 min.

EXAMPLE 6

An aqueous cleaning/degreasing concentrate formulation was prepared having the following composition:

| Component | Wt. % |
|---|---|
| $C_{12}$–$C_{13}$ linear alcohol/3 E.O. condensate ("Neodol 23-3") | 17.4 |
| Butoxy polypropylene glycol ("Dow L-1150") | 2.6 |
| Deionized water | 80.0 |
| | 100.0 |

The composition was prepared as described in Example 4 and produced a very stable, slightly bluish/white emulsion having a pH of 6.91 and a Brookfield viscosity (LV-#2 spindle, 12 rpm) of 1175 centipoise. It exhibited a low odor level.

At a 1:4 dilution with water, a bluish/white emulsion was formed having a Brookfield viscosity (LV-#2 spindle, 60 rpm) of 7.0 centipoise. The emulsion was subjected to a marking or soilant removal test with the following results:

| Marking | % Removal |
|---|---|
| Black Magic Marker felt tip | 95% |
| Black ballpoint pen | 90% |
| Blue ballpoint pen | 100% |
| #1 Hardness pencil | 100% |
| Red wax china marker | 100% |
| Composite score | 97.0% |

The composition, at a 1:4 dilution with water, was subjected to the degreasing test method of Example 1 with the following results:

1st attack on greased slide at 15 sec.

10% removal of grease at 30 sec.

33% removal of grease at 1.0 min.

55% removal of grease at 1.5 min.

75% removal of grease at 2.0 min.

90–95% removal of grease at 2.5 min.

100% removal of grease at 2.75 min.

EXAMPLE 7

An aqueous cleaning/degreasing concentrate formulation was prepared having the following composition:

| Component | Wt. % |
|---|---|
| Decanol/dodecanol/3 E.O. condensate ("Surfonic L12-3", Texaco) | 13.0 |
| Butoxy polypropylene glycol ("Dow L-1150") | 1.0 |
| Lauramide diethanolamide (1:1) ("Mackamide LLM") | 1.0 |

-continued

| Component | Wt. % |
|---|---|
| 2,2,4-Trimethyl-1,3-pentanediol monoisobutyrate ("Texanol") | 5.0 |
| Monoethanolamine | 0.03 |
| Acrylic acid/alkyl methacrylate copolymer ("Acrysol ICS-1") | 0.5 |
| Deionized water | 79.47 |
| | 100.00 |

The composition was prepared by adding water slowly to a vigorously stirred mixture of the other components. The resulting composition was a milky white emulsion having a pH of 8.17 and a brookfield viscosity (LV-#2 spindle, 60 rpm) of 475 centipoise. The emulsion exhibited excellent stability.

At a 1:4 dilution with water, the emulsion was subjected to a marking removal test with the following results:

| Marking | % Removal |
|---|---|
| Black Magic Marker felt tip | 100% |
| Black ballpoint pen | 80% |
| Blue ballpoint pen | 100% |
| #1 Hardness pencil | 100% |
| Red wax china marker | 100% |
| Composite score | 96.0% |

The composition, at a 1:4 dilution with water, was subjected to the degreasing test method of Example 1 with the following results:

15% removal of grease at 30 sec.

35–40% removal of grease at 1.0 min.

75% removal of grease at 2.0 min.

100% removal of grease at 3.0 min.

EXAMPLE 8

An aqueous cleaning/degreasing concentrate formulation was prepared having the following composition:

| Component | Wt. % |
|---|---|
| Decanol/dodecanol/3 E.O. condensate ("Surfonic L12-3", Texaco) | 16.5 |
| Butoxy polypropylene glycol ("Dow L-1150") | 1.0 |
| Lauramide diethanolamide (1:1) ("Mackamide LLM") | 0.5 |
| 2,2,4-Trimethyl-1,3-pentanediol monoisobutyrate ("Texanol") | 2.0 |
| Monoethanolamine | 0.05 |
| Acrylic acid/alkyl methacrylate copolymer ("Acrysol ICS-1") | 0.70 |
| Deionized water | 79.25 |
| | 100.00 |

The composition was prepared as in Example 7 and resulted in a milky white emulsion have a pH of 9.36 and a Brookfield viscosity (LV-#2 spindle, 12 rpm) of 2000 centipoise. The emulsion exhibited excellent stability.

At a 1:4 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |

-continued

| Marking | % Removal |
|---|---|
| #1 Hardness pencil | 100% |
| Red wax china marker | 100% |
| Composite score | 100% |

The composition, at a 1:4 dilution with water, was subjected to the degreasing test method of Example 1 with the following results:

15% removal of grease at 30 sec.

45–50% removal of grease at 1.0 min.

100% removal of grease at 2.0 min.

EXAMPLE 9

An aqueous cleaning/degreasing concentrate formulation was prepared having the following composition:

| Component | Wt. % |
|---|---|
| Decanol/dodecanol/3 E.O. condensate ("Surfonic L12-3", Texaco) | 18.6 |
| Butoxy polypropylene glycol ("Dow L-1150") | 0.4 |
| 2,2,4-Trimethyl-1,3-pentanediol monoisobutyrate ("Texanol") | 1.0 |
| Monoethanolamine | 0.06 |
| Acrylic acid/alkyl methacrylate copolymer ("Acrysol ICS-1") | 0.40 |
| Deionized water | 79.54 |
| | 100.00 |

The composition was prepared as in Example 7 and resulted in a light semi-translucent, bluish/white emulsion having a pH of 9.80 and a Brookfield viscosity (LV-#2 spindle, 6 rpm) of 5,000 centipoise. The emulsion exhibited excellent stability.

At a 1:4 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:4 dilution with water, was subjected to the degreasing test method of Example 1 with the following results:

1st attack on greased slide at 5 sec.

33% removal of grease at 30 sec.

55–60% removal of grease at 1.0 min.

85% removal of grease at 1.5 min.

100% removal of grease at 2.0 min.

EXAMPLE 10

An aqueous cleaning/degreasing concentrate formulation was prepared having the following compositions:

| Component | Wt. % |
|---|---|
| Decanol/dodecanol/3 E.O. condensate ("Surfonic L12-3", Texaco) | 16.7 |
| Butoxy polypropylene glycol ("Dow L-1150") | 1.0 |
| Lauramide diethanolamide (1:1) ("Mackamide LLM") | 0.3 |
| 2,2,4-Trimethyl-1,3-pentanediol monoisobutyrate ("Texanol") | 2.0 |
| Monoethanolamine | 0.04 |
| Acrylic acid/alkyl methacrylate copolymer ("Acrysol ICS-1") | 0.50 |
| Deionized water | 79.46 |
| | 100.00 |

The composition was prepared as in Example 7 and resulted in a white emulsion having a pH of 9.01 and a Brookfield viscosity (LV-#2 spindle, 12 rpm) of 1800 centipoise. The emulsion exhibited excellent stability.

At a 1:4 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:4 dilution with water, was subjected to the degreasing test method of Example 1 with the following results:

25% removal of grease at 30 sec.

60% removal of grease at 1.0 min.

100% removal of grease at 1.75 min.

EXAMPLE 11

A builder-containing, aqueous cleaning/degreasing concentrate formulation was prepared having the following composition:

| Component | Wt. % |
|---|---|
| Decanol/dodecanol/3 E.O. condensate ("Surfonic L12-3", Texaco) | 16.0 |
| Butoxy polypropylene glycol ("Dow L-1150") | 2.0 |
| Sodium metasilicate | 5.0 |
| Carboxy acrylic polymer ("Carbopol 940", 0.50% aq. sol.) | 77.0 |
| | 100.0 |

The "L12-3" and "L-1150" components were emulsified in the aqueous Carbopol 940 thickening agent with stirring. The sodium metasilicate was added and the mixture stirred vigorously until fully dissolved/emulsified and homogeneous. The resulting composition was a light, milky/white emulsion having a pH of 13.02 and a Brookfield viscosity (LV-#2 spindle, 30 rpm) of 500 centipoise. It exhibited excellent stability.

At a 1:4 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:4 dilution with water, was subjected to the degreasing test method of Example with the following results:

20% removal of grease at 30 sec.

45–50% removal of grease at 1.0 min.

75% removal of grease at 1.5 min.

100% removal of grease at 2.17 min.

EXAMPLE 12

A builder-containing, aqueous cleaning/degreasing concentrate formulation was prepared having the following composition:

| Component | Wt. % |
|---|---|
| Lauryl alcohol/4.0 E.O. condensate ("Laureth-4") | 7.0 |
| Butoxy polypropylene ("Dow L-1150") | 3.0 |
| Sodium salt of EDTA ("Hampene 100S") | 6.0 |
| Carboxy acrylic polymer ("Carbopol 940", 0.5% aq. sol.) | 84.0 |
| | 100.0 |

The "Laureth-4" and L-1150" were emulsified in the stirred aqueous "Carbopol 940" to which the aqueous "Hampene 100S" was added with vigorous stirring (thickening). The pH was adjusted from 9.0 to 10.0 by the addition of 50% aqueous sodium hydroxide with stirring. The resulting composition was an intensely white colored, fluid emulsion having a pH of 10.0 and a Brookfield viscosity (LV-42 spindle, 12 rpm) of 2,000 centipoise. It exhibited excellent stability for one month at ambient temperature and at 45° C.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 5 sec.

30% removal of grease at 30 sec.

65% removal of grease at 1.0 min.

90–95% removal of grease at 2.0 min.

100% removal of grease at 2.17 min.

EXAMPLE 13

A builder-containing, aqueous cleaning/degreasing concentrate formulation was prepared having the following composition:

| Component | Wt. % |
|---|---|
| Lauryl alcohol/4.0 E.O. condensate ("Laureth-4") | 5.0 |
| 2,2,4-Trimethyl-1,3-pentadendiol monoisobutyrate ("Texanol") | 5.0 |
| Sodium salt of EDTA ("Hampene 100S") | 5.0 |
| Acrylic acid/alkyl methacrylate copolymer ("Acrysol ICS-1") | 2.0 |
| Deionized water | 83.0 |
| | 100.0 |

The composition was prepared as described in Example 11 and was an intensely white, fluid emulsion having a pH of 10.0 and a Brookfield viscosity (LV-#2 spindle, 60 rpm) of 440 centipoise. It exhibited excellent stability for more than one month at ambient temperature and at 45° C.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 6 sec.

30% removal of grease at 30 sec.

55% removal of grease at 1.0 min.

80% removal of grease at 2.0 min.

100% removal of grease at 2.83 min.

EXAMPLE 14

A builder-containing, aqueous cleaning/degreasing concentrate formulation was prepared having the following composition:

| Component | Wt. % |
|---|---|
| Decanol/dodecanol/3 E.O. condensate ("Surfonic L12-3", Texaco) | 5.0 |
| 2,2,4-Trimethyl-1,3-pentanediol monoisobutyrate ("Texanol") | 5.0 |
| Sodium salt of EDTA ("Hampene 100S") | 6.0 |
| Acrylic acid/alkyl methacrylate copolymer ("Acrysol ICS-1") | 2.5 |
| Deionized water | 81.5 |
| | 100.0 |

The composition was prepared by dispersing the "L12-3" and "Texanol" in water with stirring. To this dispersion was added the "ICS-1" slowly with stirring. Finally, the "Hampene 100S" was added with stirring and the pH adjusted to 10.0. The resulting composition was an intensely white emulsion having a Brookfield viscosity (LV-#3 spindle, 30 rpm) of 1720 centipoise. The emulsion exhibited excellent stability for more than one month at ambient temperature and at 45° C.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

In each instance, the emulsion effected a fast removal of the marking. The composition, at a 1:2 dilution with water, was subjected to the degreasing test method of Example 1 with the following results:

10–15% removal of grease at 30 sec.

30% removal of grease at 1.0 min.

60% removal of grease at 2.0 min.

90% removal of grease at 3.0 min.

100% removal of grease at 3.33 min.

EXAMPLE 15

A builder-containing, aqueous cleaning/degreasing concentrate formulation was prepared having the following composition:

| Component | Wt. % |
|---|---|
| Decanol/dodecanol/3 E.O. condensate ("Surfonic L12-3", Texaco) | 6.0 |
| Butoxy polypropylene glycol ("Dow L-1150") | 2.0 |
| 2,2,4-Trimethyl-1,3-pentanediol monoisobutyrate ("Texanol") | 2.0 |
| Sodium salt of EDTA ("Hampene 100S") | 5.0 |
| Carboxy acrylic polymer ("Carbopol 940", 0.75% aq. sol.) | 85.0 |
| | 100.0 |

The "L12-3", "L-1150" and "Texanol" were emulsified in the aqueous "Carbopol 940" with vigorous stirring. The "Hampene 100S" was then added slowly to the stirred emulsion (thickening) and the pH adjusted to 10.0 by the dropwise addition of aqueous 50% sodium hydroxide with stirring. The resulting composition was a bluish/white, somewhat translucent emulsion having a Brookfield viscosity (LV-#3) spindle, 12 rpm) of 4,280 centipoise. The emulsion exhibited excellent stability for more than one month at room temperature and at 45° C.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

In each instance, the composition effected easy, rapid removal of the marking.

The composition, at a 1:2 dilution with water, was subjected to the degreasing test method of Example 1 with the following results:

20–25% removal of grease at 30 sec.

50% removal of grease at 1.0 min.

90% removal of grease at 2.0 min.

100% removal of grease at 2.25 min.

EXAMPLE 16

A builder-containing, aqueous cleaning/degreasing formulation was prepared having the following composition:

| Component | Wt. % |
|---|---|
| Decanol/dodecanol/3 E.O. condensate ("Surfonic L12-3", Texaco) | 5.5 |
| Butoxy polypropylene glycol ("Dow L-1150") | 2.0 |
| 2,2,4-Trimethyl-1,3-pentanediol monoisobutyrate ("Texanol") | 2.5 |
| Sodium salt of EDTA ("Hampene 100S") | 4.5 |
| Carboxy acrylic polymer ("Carbopol 940", 0.75% aq. sol.) | 85.5 |
| | 100.0 |

The composition was prepared as described in Example 15 and resulted in a light, translucent bluish/white, creamy emulsion having a Brookfield viscosity (LV-#3 spindle, 12 rpm) of 4,300 centipoise. The composition exhibited excellent stability for more than one month at ambient temperature and at 45° C.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

In each instance, the emulsion effected easy, rapid removal of the marking.

The composition, at a 1:2 dilution with water, was subjected to the degreasing test method of Example 1 with the following results:

25% removal of grease at 30 sec.

55% removal of grease at 1.0 min.

90–95% removal of grease at 2.0 min.

100% removal of grease at 2.17 min.

EXAMPLE 17

A builder-containing, aqueous cleaning/degreasing formulation was prepared having the following composition:

| Component | Wt. % |
|---|---|
| polyetheneoxy ethanol ("NP-6") | 5.0 |
| 2,2,4-Trimethyl-1,3-pentanediol monoisobutyrate ("Texanol") | 5.0 |
| Sodium salt of EDTA ("Hampene 100S") | 5.0 |
| Acrylic acid/alkyl methacrylate copolymer ("Acrysol ICS-1") | 2.5 |
| Deionized water | 82.5 |
| | 100.0 |

The composition was prepared by emulsifying the "NP-6" and "Texanol" in water with stirring to which emulsion the "ICS-1" was added with stirring. While stirring, the "Hampene 100S" was added (thickening) followed by the dropwise addition of aqueous 50% sodium hydroxide to adjust the pH to 10.0. The resulting composition was an intensely white colored emulsion having a Brookfield viscosity (LV-#2 spindle, 12 rpm) of 1,625 centipoise. The emulsion exhibited excellent stability for more than one month at ambient temperature and at 45° C.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

In each instance, the emulsion effected fast removal of the marking.

The composition, at a 1:2 dilution with water, was subjected to the degreasing test method of Example 1 with the following results:

5–10% removal of grease at 30 sec.

15% removal of grease at 1.0 min.

40% removal of grease at 2.0 min.

70% removal of grease at 3.0 min.

100% removal of grease at 4.25 min.

EXAMPLE 18

An aqueous cleaning/degreasing formulation was prepared having the following composition:

| Component | Wt. % |
|---|---|
| $C_{11}$–$C_{15}$ secondary alcohol/5 E.O. condensate ("Tergitol 15-S-5") | 6.0 |
| Lauramide diethanolamide (1:1) ("Mackamide LLM") | 4.0 |
| 1,2-Dibutyl phthalate | 11.0 |
| Deionized water | 79.0 |
| | 100.0 |

The first three components were premixed and the water added thereto and the mixture stirred until homogeneous. The resulting composition was an odorless, intensely white emulsion having a pH of 8.29 and a Brookfield viscosity (LV #3 spindle, 12 rpm) of 2,450 centipoise.

At a dilution of 1:2 with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing following results:

1st attack on greased slide at 3 sec.

25% removal of grease at 15 sec.

45–50% removal of grease at 30 sec.

70% removal of grease at 45 sec.

90% removal of grease at 1.0 min.

100% removal of grease at 1.25 min.

EXAMPLE 19

An aqueous cleaning/degreasing formulation was prepared having the following composition:

| Component | Wt. % |
|---|---|
| $C_{11}$–$C_{15}$ secondary alcohol/5 E.O. condensate ("Tergitol 15-S-5") | 8.0 |
| Dipropyleneglycol dibenzoate | 2.0 |
| Acrylic acid/alkyl methacrylate copolymer ("Acusol 820", 30% total solids) | 0.5 |
| Triethanolamine | 0.15 |
| Deionized water | 89.35 |
| | 100.00 |

The "Acusol 820" was added to water with stirring followed by a preblend of the first two components with stirring. Finally, the triethanolamine was added with stirring. The resulting composition was a white colored, odorless emulsion having a pH of 7.0 and a Brookfield viscosity (LV-#2 spindle, 30 rpm) of 850 centipoise. The emulsion exhibited excellent stability.

At a dilution of 1:2 with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 4.0 sec.

40% removal of grease at 30 sec.

75–80% removal of grease at 1.0 min.

100% removal of grease at 1.75 min.

EXAMPLE 20

An aqueous cleaning/degreasing formulation was prepared having the following composition:

| Component | Wt. % |
|---|---|
| Soyamide diethanolamide (1:1) ("Mackamide S") | 11.0 |
| 2,2,4-trimethyl-1,3-pentanediol monoisobutyrate ("Texanol") | 10.0 |
| Deionized water | 79.0 |
| | 100.0 |

Water was added to a stirred premix of the first two components and the mixture stirred until homogeneous. The resulting composition was a pale beige/yellow creamy emulsion having a pH of 10.08 and a Brookfield viscosity (LV-#2 spindle, 60 rpm) of 145 centipoise. The emulsion exhibited excellent stability.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 9 sec.

30% removal of grease at 1.0 min.

60% removal of grease at 2.0 min.

90% removal of grease at 3.0 min.

100% removal of grease at 3.5 min.

EXAMPLE 21

An aqueous cleaning/degreasing formulation was prepared having the following composition:

| Component | Wt. % |
|---|---|
| "Tergitol 15-S-3" | 12.0 |
| Diphenyl ether | 8.0 |
| "Acusol 820" | 0.7 |
| Triethanolamine | 0.2 |
| Deionized water | 79.1 |
| | 100.0 |

The composition was prepared as described in Example 19. The resulting composition was an intensely white emulsion with a pale floral odor having a pH of 7.52 and a Brookfield viscosity (LV-#3 spindle, 12 rpm) of 1,870 centipoise. The emulsion exhibited excellent stability.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 2 sec.

30% removal of grease at 15 sec.

55% removal of grease at 30 sec.

80% removal of grease at 45 sec.

100% removal of grease at 1.17 min.

EXAMPLE 22

An aqueous cleaning/degreasing formulation was prepared having the following composition:

| Component | Wt. % |
|---|---|
| "Tergitol 15-S-3" | 8.5 |
| Lauramide diethanolamide (1:1) ("Mackamide LLM") | 1.7 |
| "L-910" | 7.1 |
| Deionized water | 82.7 |
| | 100.0 |

The water was added slowly to the stirred mixture of the other components with thickening and emulsification. The resulting composition was a white colored emulsion having a pH of 9.17 15 and a Brookfield viscosity (LV-#3 spindle, 12 rpm) of 3,570 centipoise. The emulsion exhibited excellent stability.

At a dilution of 1:2 with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 1–2 sec.

30 35–40% removal of grease at 15 sec.

65% removal of grease at 30 sec.

85% removal of grease at 45 sec.

100% removal of grease at 55 sec.

A 1"×3" sheet aluminum coupon was smear coated with Mobil 28 Lithium grease on one side only to a distance of 1.0" from the bottom edge to provide a 1.0"×1.0" coated area. This was inserted into 110 ml. of a 1:10 diluted sample of the above emulsion composition contained in a 150 ml. beaker fitted with a 1½"×⅜" magnetic stirrer/hot plate heated to and maintained at 165–170° F. and stirred with vigorous agitation. The coupon was held in a clamp and time "0" was noted when insertion was made into the stirred/heated bath.

Total removal of the Mobil 28 Lithium grease occurred within a lapsed time of 1.42 minutes. Upon cessation of stirring, the released globules of grease floated to the top of the bath and coalesced, forming a grease layer easily separated from the bath, both under heated conditions as well as cooled to ambient temperatures.

EXAMPLE 23

An aqueous cleaning/degreasing formulation was prepared having the following composition:

| Component | Wt. % |
|---|---|
| "Tergitol 15-S-3" | 6.5 |
| Tridecanol (Exxon Corp.) | 6.5 |
| "Acusol 820", 30% | 0.5 |

-continued

| Component | Wt. % |
|---|---|
| Triethanolamine | 0.3 |
| Deionized water | 86.2 |
| | 100.0 |

To stirred water was added in order the "Tergitol 15-S-3", tridecanol, "Acusol 820" and finally, with vigorous stirring, the triethanolamine (instant thickening). The mixture was stirred for 15 minutes at ambient temperature. The resulting composition was an intensely white colored emulsion having a pH of 8.72 and a Brookfield viscosity (LV-#3 spindle, 12 rpm) of 2,940 centipoise. The emulsion exhibited excellent stability.

At a dilution of 1:2 with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a dilution of 1:2 with water, was subjected to the degreasing test method of Example 1 with the following results:

1st attack on greased slide at 4 sec.

40% removal of grease at 30 sec.

75% removal of grease at 1.0 min.

100% removal of grease at 1.83 min.

EXAMPLE 24

An aqueous cleaning/degreasing formulation was prepared having the following composition:

| Component | Wt. % |
|---|---|
| Polyethylene glycol (400) monooleate ("Mopeg 400 MO") | 9.0 |
| DiButyl phthalate | 4.5 |
| Diphenyl ether | 4.5 |
| "Acusol 820", 30% | 0.5 |
| Triethanolamine | 0.2 |
| Deionized water | 81.3 |
| | 100.0 |

The composition was prepared as described in Example 23 and resulted in an intensely white emulsion with a pale floral odor having a pH of 7.25 and a Brookfield viscosity (LV-#3 spindle, 12 rpm) of 3,860 centipoise. The emulsion exhibited excellent stability.

At a dilution of 1:2 with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |

-continued

| Marking | % Removal |
|---|---|
| #1 Hardness pencil | 100% |
| Red wax china marker | 100% |
| Composite score | 100% |

The composition, at a 1:2 dilution with water, was subjected to the degreasing test method of Example 1 with the following results:

1st attack on grease at 3 sec.

40–45% removal of grease at 30 sec.

75% removal of grease at 1.0 min.

100% removal of grease at 1.5 min.

EXAMPLE 25

An aqueous cleaning/degreasing formulation was prepared having the following composition:

| Component | Wt. % |
|---|---|
| Polyethylene glycol (200) monolaurate ("Mopeg 200 ML") | 12.0 |
| Dioctyl adipate (di 2-ethylhexyl adipate, "DOA") | 6.0 |
| "Acusol 820", 30% | 0.5 |
| Triethanolamine | 0.15 |
| Deionized water | 81.35 |
| | 100.00 |

The composition was prepared as described in Example 23 and resulted in a creamy, white colored emulsion having a pH of 7.0 and a Brookfield viscosity (LV-43 spindle, 12 rpm) of 2,230 centipoise. The emulsion exhibited very good stability.

At a dilution of 1:2 with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 7 sec.

40% removal of grease at 1.0 min.

70–75% removal of grease at 2.0 min.

100% removal of grease at 3.08 min.

EXAMPLE 26

An aqueous cleaning/degreasing formulation was prepared having the following composition:

| Component | Wt. % |
|---|---|
| $C_{12}$–$C_{14}$ linear aliphatic alcohol/2.0 E.O. condensate ("Surfonic 24-2") | 8.0 |

-continued

| Component | Wt. % |
|---|---|
| Butoxy polypropylene glycol ("Dow L-910") | 4.0 |
| Triethanolamine | 0.2 |
| "Carbopol 690", 0.10 wt. % aqueous | 87.8 |
| | 100.0 |

The "Surfonic 24-2", "Dow L-910" and triethanolamine were added in order to the vigorously stirred aqueous "Carbopol 690". The resulting composition was a white colored emulsion with a very bland odor having a pH of 7.86 and a Brookfield viscosity (LV-#3 spindle, 12 rpm) of 2,120 centipoise.

At a 1:2 dilution with water, the emulsion was subjected to a marking removal test with the following results:

| Marking | % Removal |
|---|---|
| Black Magic Marker felt tip | 100% |
| Black ballpoint pen | 95% |
| Blue ballpoint pen | 90% |
| #1 Hardness pencil | 100% |
| Red wax china marker | 100% |
| Composite score | 97% |

The composition, at a 1:2 dilution with water, was subjected to the degreasing test method of Example 1 with the following results:

1st attack on greased slide at 4 sec.

35–40% removal of grease at 30 sec.

65% removal of grease at 1.0 min.

85% removal of grease at 1.5 min.

100% removal of grease at 2.0 min.

EXAMPLE 27

An aqueous cleaning/degreasing formulation was prepared having the following composition:

| Component | Wt. % |
|---|---|
| Isostearamide diethanolamide (1:1) ("Monamide 150-IS") | 1.5 |
| Butoxy polypropylene glycol ("Dow L-910") | 1.5 |
| Sodium benzoate | 0.2 |
| Ammonium hydroxide (28% $NH_3$) | 0.05 |
| Deionized water | 96.75 |
| | 100.00 |

The resulting composition was a stable, bluish-white, fluid emulsion, almost odorless, having a pH of 9.97.

The composition was aerosolized in a 6 oz. aerosol can using 8.32g (15.0 ml) of a propane/isobutane blend propellant (trade designation "A-55"). The can was equipped with an AR-75 valve and Marc 18-1525 actuator. The fill ratio was 87/13.

It was found that the resulting aerosol formulation totally removed the following markings from alkyd enameled metal surfaces: Black felt tip Magic Marker; black ballpoint pen; blue ballpoint pen; red (wax) china marker; #1 hardness pencil; automotive grease; Texaco Motor Gear Lube Premium and Mobil 28 Lithium Grease. The aerosol formulation also readily removed fingerprints, scuff marks, smudges, heelmarks, and similar markings from walls, doors, countertops, woodwork and the like.

EXAMPLE 28

An acqueous cleaning/degreasing formulation was prepared having the following composition:

| Component | Wt. % |
|---|---|
| Lauramide diethanolamide (1:1) ("Mackamide LLM") | 10.0 |
| 2,2,4-Trimethyl-1,3-pentane-diol monoisobutyrate ("Texanol") | 10.0 |
| Deionized water | 80.0 |
| | 100.0 |

The water was added slowly to the other two components and phase inversion emulsification occurred resulting in a creamy white emulsion having a pH of 9.43 and a Brookfield viscosity (LV-#2 spindle, 60 rpm) of 70 centipoise. The emulsion exhibited excellent stability.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 2 sec.

45–50% removal of grease at 30 sec.

85% removal of grease at 1.0 min.

100% removal of grease at 1.25 min.

EXAMPLE 29

An aqueous cleaning/degreasing formulation was prepared having the following composition:

| Component | Wt. % |
|---|---|
| Lauramide diethanolamide (1:1) ("Mackamide LLM") | 6.0 |
| 2,2,4-Trimethyl-1,3-pentane-diol monoisobutyrate ("Texanol") | 12.0 |
| Deionized water | 82.0 |
| | 100.0 |

The composition was prepared as described in Example 28 and resulted in an odorless, intensely bluish-white emulsion having a pH of 9.40 and a Brookfield viscosity (LV-#2 spindle, 60 rpm) of 190 centipoise. The emulsion exhibited excellent stability.

At a 1:2 dilution with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |

-continued

| Marking | % Removal |
|---|---|
| #1 Hardness pencil | 100% |
| Red wax china marker | 100% |
| Composite score | 100% |

The composiiton, at a 1:2 dilution with water, was subjected to the degreasing test method of Example 1 with the following results:

1st attack on greased slide at 1 sec.

40% removal of grease at 15 sec.

70% removal of grease at 30 sec.

100% removal of grease at 50 sec.

EXAMPLE 30

An aqueous cleaning/degreasing formulation was prepared having the following composition:

| Component | Wt. % |
|---|---|
| "Tergitol 15-S-5" | 6.0 |
| Benzoin isobutyl ether (Aldrich #19, 578-2) | 6.0 |
| "Acusol 820", 30% | 0.4 |
| Triethanolamine | 0.2 |
| Deionized water | 87.4 |
| | 100.0 |

The first two components were emulisified in water with stirring followed by the addition of the "Acusol 820" and triethanolamine. The resulting composition was a creamy yellow colored emulsion having a pH of 7.92 and a Brookfield viscosity (LV-#3 spindle, 12 rpm) of 4,950 centipoise. It exhibited good stability.

At a dilution of 1:2 with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution wiht water, was subjected to the degreasing test method of Example 1 with the following results:

1st attack on greased slide at 2 sec.

40% removal of grease at 30 sec.

80% removal of grease at 1.0 min.

100% removal of grease at 2.33 min.

EXAMPLE 31

An aqueous cleaning/degresing formulation was prepared having the following composition:

| Component | Wt. % |
|---|---|
| Chelating agent ("Hampene 100S"), 40% aq. | 0.5 |
| Sodium metasilicate · 5 $H_2O$ | 2.0 |
| Sodium nitrite | 0.5 |
| "Acusol 820", 30% aq. | 3.0 |
| "Tergitol 15-S-5" | 7.0 |
| "L-910" | 3.0 |
| Deionized water | 84.0 |
| | 100.0 |

The first three components were dissolved in water with stirring and, while stirring, the remaining three components were added in order. The mixture was stirred for 15 minutes at room temperature. The resulting composition was a white, viscous emulsion having a pH of 12.42 and a Brookfield viscosity (LV-#3 spindle, 12 rpm) of 2,100 centipoise. It exhibited excellent stability.

At a dilution of 1:2 with water, the emulsion was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition, at a 1:2 dilution with water, was subjected to the degreasing test method of Example 1 with the following results:

1st attack on greased slide at 1 sec.

40% removal of grease at 15 sec.

75% removal of grease at 30 sec.

100% removal of grease at 45 sec.

EXAMPLE 32

An aqueous cleaning/degreasing formulation was prepared having the following composition:

| Component | Wt. % |
|---|---|
| Sodium metasilicate · 5 $H_2O$ | 2.2 |
| Sodium nitrite | 0.5 |
| "Tergitol 15-S-5" | 10.0 |
| Polybutylene glycol 1000 | 2.5 |
| "Carbopol 690", 1.0% aqueous | 66.7 |
| Deionized water | 18.1 |
| | 100.0 |

The first two components were added with stirring to the aqueous "Carbopol 690" (instant thickening) followed by the addition of the polybutylene glycol 1000 and "Tergitol 15-S-5" with vigorous stirring for 15 minutes. The resulting composition was an intensely white, viscous emulsion having a pH of 11.72 and a Brookfield viscosity (LV-#3 spindle, 12 rpm) of 5400 centipoise. It exhibited excellent stability.

At a 1:2 dilution with water, the emulsion was subjected to a marking removal test with the following results:

| Marking | % Removal |
|---|---|
| Black Magic Marker felt tip | 90% |
| Black ballpoint pen | 90% |
| Blue ballpoint pen | 100% |
| #1 Hardness pencil | 100% |
| Red wax china marker | 100% |
| Composite score | 96% |

The composition, at a 1:2 dilution with water, was subjected tot he degreasing test method of Example 1 with the following results:

1st attack on greased slide at 2 sec.

45% removal of grease at 30 sec.

80–85% removal of grease at 1.0 min.

100% removal of grease at 1.33 min.

EXAMPLE 33

An aqueous cleaning/degreasing formulation was prepared having the following composition:

| Component | Wt. % |
|---|---|
| Sodium metasilicate · 5 $H_2O$ | 2.5 |
| Sodium nitrite | 0.5 |
| "Tergitol 15-S-5" | 7.0 |
| "L-910" | 3.0 |
| "Carbopol 690", 1.0% aqueous | 70.0 |
| Deionized water | 17.0 |
| | 100.0 |

The composition was prepared as described in Example 32 and resulted in a white colored, thickened emulsion having a pH of 12.08 and a Brookfield viscosity (LV-#3 spindle, 12 rpm) of 2,620 centipoise. It exhibited excellent stability.

The composition was employed in cleaning/degreasing of automotive lubes and greases using a heated (160° F. maintained), stirred bath with the composition at a 1:2 dilution with water. The lubes, greases, etc. were applied to 1"×3" sheet aluminum coupons as light coatings/films. The times required for 100% removal of the various lubes and greases was as follows:

| Product | Degreasing Time |
|---|---|
| Mobil 28 Lithium Grease | 30 sec. |
| Takilube (outside gear lubricant) | 10 sec. |
| Texaco "Motor Gear Lube Premium" | 15 sec. |
| "Everstay Polymer 100" (Industrial Lubricants, Cincinnati, Ohio) | 1.5 min. |

EXAMPLE 34

An aqueous cleaning/degreasing formulation was prepared having the following composition:

| Component | Wt. % |
|---|---|
| Monethanolamine | 0.95 |
| "Tergitol 15-S-5" | 7.0 |
| "L-910" | 3.0 |
| Sodium metasilicate · 5$H_2O$ | 3.5 |

-continued

| Component | Wt. % |
|---|---|
| Sodium nitrite | 0.5 |
| "Carbopol 690", 1% aqueous | 85.05 |
| | 100.00 |

The composition was prepared as described in Example 32 and resulted in a white, viscous emulsion having a pH of 12.55 and a Brookfield viscosity (LV-#3 spindle, 12 rpm) of 4,150 centipoise. It exhibited excellent stability.

This emulsion at full strength was found to readily remove a baked on Skydrol/carbon (Norit A) suspension from aluminum surfaces.

At a 1:16 dilution with water, the composition readily removed fingerprinting, smudge markings and the like.

The formulation passed the 8 hour stress crazing test (ASTM F484-83) on Type A Acrylic (MIL 5425).

EXAMPLE 35

An aqueous cleaning/degreasing formulation was prepared having the following composition:

| Component | Wt. % |
|---|---|
| "Tergitol 15-S-5" | 4.0 |
| Monoethanolamine | 0.95 |
| Sodium metasilicate · 5$H_2O$ | 1.0 |
| Polypropylene glycol ("P-2000") | 2.0 |
| Cocodimethylamine N-oxide, 30% | 2.0 |
| Xanthan gum (Rhodopol 50-MD), 1.0% | 90.05 |
| | 100.00 |

The resulting composition was a creamy colored, viscous emulsion having a pH of 12.8 and a Brookfield viscosity (LV-#3 spindle, 12 rpm) of 2,650 centipoise. It exhibited excellent stability.

The emulsion at full strength was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition easily removed 4 day baked-on Skydrol/carbon (Norit A) suspension from aluminum surfaces.

The composition readily passed the 8 hour stress crazing test on Type A Acrylic MIL 5425 (ASTM F484-83).

EXAMPLE 36

An aqueous cleaning/degreasing formulation was prepared having the following composition:

| Component | Wt. % |
|---|---|
| Lauramino propionic acid ("151-L") | 2.0 |
| Tridecanol | 4.0 |
| Polypropylene glycol ("P-2000") | 4.0 |

-continued

| Component | Wt. % |
|---|---|
| Sodium metasilicate · $5H_2O$ | 0.5 |
| Aeromaster | 40.0 |
| Deionized water | 49.5 |
| | 100.0 |

Aeromaster has the following and is desclosed in my copending and coassigned application Ser. No. 289,754.

| | |
|---|---|
| Cocamine oxide, 30% | 5.0 |
| "Acusol 820" | 3.75 |
| Sodium metasilicate · $5H_2O$ | 2.0 |
| Sodium nitrite | 0.5 |
| Deionized water | 88.75 |
| | 100.00 |

The resulting composition was an intensely white, viscous emulsion (slightly curdy) having a pH of 11.5 and a Brookfield viscosity (LV-#3 spindle, 12 rpm) of 5,100 centipoise. It exhibited excellent stability.

The emulsion at full strength was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition easily removed 4 day baked-on Skydrol/carbon (Norit A) suspension from aluminum surfaces.

The composition readily passed the 8 hour stress crazing test on Type A Acrylic MIL 5425 (ASTM F484-83).

EXAMPLE 37

An aqueous cleaning/degreasing formulation was prepared having the following composition:

| Component | Wt. % |
|---|---|
| N,N-Cetylethyl morpholinium ethosulfate ("Berquat CME-ET") | 1.1 |
| Polypropylene glycol ("P-2000") | 2.9 |
| Tridecanol | 4.0 |
| Lauramino propionic acid ("151-L") | 1.1 |
| Aeromaster | 45.5 |
| Deonized water | 45.4 |
| | 100.0 |

The resulting composition was an intensely white, viscous emulsion having a pH of 11.1 and a Brookfield viscosity (LV-#3 spindle, 12 rpm) of 6,400 centipoise. It exhibited excellent stability.

The emulsion at full strength was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The composition easily removed 4 day baked-on Skydrol/carbon (Norit A) suspension from aluminum surfaces.

The composition readily passed the 8 hour stress crazing test on Type A Acrylic MIL 5425 (ASTM F484-83).

EXAMPLE 38

An aqueous cleaning/degreasing formulation was prepared having the following composition:

| Component | Wt. % |
|---|---|
| Sodium metasilicate · $5H_2O$ | 5.0 |
| Alkylphenol ethoxylate ("Triton X-45") | 2.0 |
| Polypropylene glycol 2000 | 4.0 |
| "Acusol 820", 30% | 2.0 |
| Deionized water | 87.00 |
| | 100.00 |

The resulting composition was a very stable, very white, creamy emulsion having no odor, a pH of 12.9 and a Brookfield viscosity (LV-#2 spindle, 60 rpm) of 149 centipoise.

The floor stripping characteristics of this composition were determined by using coated vinyl tile and a green mesh nylon pad. At a 1:4 dilution with water, the composition was applied to vinyl tile coated with three coats of floor finish and sealer compositions sold under the trade designations "1st Down" and "Cirene". After a 10 minute hold period, the composition readily stripped the coated vinyl tile using a green mesh nylon pad for 15–20 seconds. At a 1:10 dilution with water, the composition was applied to vinyl tile coated with eight coats of floor finish and sealer compositions sold under the trade designations "Citation", "Castelguard" and "Mainstream" by Buckeye International, Inc. After a 10 minute hold period, the composition readily stripped the coated vinyl tile using a green mesh nylon pad for 15–20 seconds.

EXAMPLE 39

An aqueous cleaning/degreasing formulation was prepared having the following composition:

| Component | Wt. % |
|---|---|
| Tall aid fatty acid ("Pamak 4A", Hercules, Inc.) | 10.0 |
| "Acusol 820" | 1.5 |
| Ammonium hydroxide | 0.26 |
| Deionized water | 88.24 |
| | 100.00 |

The resulting composition was a light yellow, slightly thickened emulsion having a pH of 7.1 and a Brookfield viscosity, (LV-#2 spindle, 60 rpm) of 244 centipoise.

The emulsion at full strength was subjected to a marking removal test with the following results:

| Marking | % Removal |
|---|---|
| Black Magic Marker felt tip | 100% |
| Black ballpoint pen | 100% |
| Blue ballpoint pen | 100% |
| #1 Hardness pencil | 100% |
| Red wax china marker | 100% |
| Composite score | 100% |

The emulsion readily removed oils and greases from soiled surfaces upon wiping.

The emulsion was subjected to the degreasing test method of Example 1 with the following results:

20% removal of grease at 35 sec.

40% removal of grease at 55 sec.

60% removal of grease at 1 min. 10 sec.

85–90% removal of grease at 1 min. 20 sec.

100% removal of grease at 1 min. 40 sec.

In view of the above, it will be seen that the several objects of the invention are achieved and other advantageous results attained.

As various changes could be made in the above products without departing from the scope of the invention, it is intended that all matter contained in the above description shall be interpreted as illustrative and not in a limiting sense.

What is claimed is:

1. A low volatile organic component stable, aqueous cleaning/degreasing composition in the form of a macroemulsion consisting essentially of:

(a) a nonionic surfactant characterized by
- (i) having an aqueous solubility in the range of approximately 0.1 to 5 wt. %;
- (ii) having a cloud point of ≦20° C. at a concentration of 1.0 wt. % in water;
- (iii) having a hydrophilic/lipophilic balance (HLB) between approximately 3 and 12;
- (iv) having a minimum composite score of 60% removal in the soilant markings removal test method;
- (v) being self-emulsifiable in water; and
- (vi) being selected from the group consisting of ethoxylated alkanols, ethoxylated alkylphenols and ethoxylated carboxylic acids, polyol esters, polyetherol esters, and 1:1 diethanolamides;

(b) an oligomeric or mono/polyfuctional hydrophobe characterized by
- (i) having an aqueous solubility between approximately 0.01 and 0.08 wt. %;
- (ii) having a viscosity not exceeding approximately 5,000 centipoise at ambient temperature;
- (iii) being miscible with and capable of forming a liquid macroemulsion with said nonionic surfactant;
- (iv) being capable of suppressing the aqueous solubility of said nonionic surfactant;
- (v) having a low volatility not exceeding approximately 0.02 mm at 25° C.;
- (vi) not being a hydrocarbon or halocarbon,
- (vii) being a solvent for hydrophobic soilants; and
- (viii) having one or more oxygen containing functional groups; and (c) water;

said nonionic surfactant and said hydrophobe being present in a weight ratio of between approximately 5:1 and 1:1.5 and said composition having a minimum composite score of 60% removal in the soilant markings removal test.

2. A low volatile organic component stable, aqueous cleaning/degreasing composition as set forth in claim 1 wherein said hydrophobe is further characterized by having a molecular weight not exceeding approximately 10,000.

3. A low volatile organic component stable, aqueous cleaning/degreasing composition as set forth in claim 2 wherein said molecular weight is between approximately 200 and 2,000.

4. A low volatile organic component stable, aqueous cleaning/degreasing composition as set forth in claim 1 wherein said hydrophobe is polypropylene glycol.

5. A low volatile organic component stable, aqueous cleaning/degreasing composition as set forth in claim 1 wherein said hydrophobe is polypropylene glycol butyl ether.

6. A low volatile organic component stable, aqueous cleaning/degreasing composition as set forth in claim 1 wherein said hydrophobe is butoxy polypropylene glycol.

7. A low volatile organic component stable, aqueous cleaning/degreasing composition as set forth in claim 1 wherein said nonionic surfactant has an HLB between approximately 8 and 11.

8. A low volatile organic component stable, aqueous cleaning/degreasing composition as set forth in claim 1 wherein said surfactant is an ethoxylated alkanol.

9. A low volatile organic component stable, aqueous cleaning/degreasing composition as set forth in claim 1 wherein said surfactant is an alkylphenol ethoxylate.

10. A low volatile organic component stable, aqueous cleaning/degreasing composition as set forth in claim 1 wherein said surfactant is decanol/dodecanol/3 E.O. condensate.

11. A low volatile organic component stable, aqueous cleaning/degreasing composition as set forth in claim 1 wherein said surfactant is decyl alcohol/4 E.O. condensate.

12. A low volatile organic component stable, aqueous cleaning/degreasing composition as set forth in claim 1 wherein said surfactant is a 1:1 diethanolamide.

13. A low volatile organic component stable, aqueous cleaning/degreasing composition as set forth in claim 1 additionally consisting essentially of from approximately 0.2 to 1 wt. % of a thickener.

14. A low volatile organic component stable, aqueous cleaning/degreasing composition as set forth in claim 13 wherein said thickener is an acrylic acid/alkyl methacrylate copolymer.

15. A low volatile organic component stable, aqueous cleaning/degreasing composition as set forth in claim 13 wherein said thickener is a carboxy acrylic polymer.

16. A low volatile organic component stable, aqueous cleaning/degreasing composition as set forth in claim 1 additionally consisting essentially of an alkali metal silicate and an alkali metal nitrite.

17. A low volatile organic component stable, aqueous cleaning/degreasing composition as set forth in claim 16 wherein said alkali metal silicate is sodium metasilicate and said alkali metal nitrite is sodium nitrite.

18. A low volatile organic component stable, aqueous cleaning/degreasing composition as set forth in claim 1 additionally consisting essentially of one or more optional adjuvants selected from the group consisting of chelants, fragrances, dyes, pH adjustants and anti-rust additives.

* * * * *